US005088466A

United States Patent [19]

Tada

[11] Patent Number: 5,088,466

[45] Date of Patent: Feb. 18, 1992

[54] EVAPORATED FUEL GAS PURGING SYSTEM

[75] Inventor: Yasuo Tada, Hyogo, Japan

[73] Assignee: Mitsubishi Denki K.K., Tokyo, Japan

[21] Appl. No.: 726,082

[22] Filed: Jul. 5, 1991

[30] Foreign Application Priority Data

Jul. 6, 1990 [JP] Japan ..... 2-180222
Jul. 17, 1990 [JP] Japan ..... 2-191656

[51] Int. Cl.[5] ..... F02M 33/02

[52] U.S. Cl. ..... 123/519; 123/520; 123/494; 55/270

[58] Field of Search ..... 123/494, 516, 518, 519, 123/520, 521; 55/270, 18, 462, 387, 418

[56] References Cited

U.S. PATENT DOCUMENTS

| | | | |
|---|---|---|---|
| 4,116,184 | 9/1978 | Tomita | 123/519 |
| 4,338,905 | 7/1982 | Urich | 123/518 |
| 4,748,959 | 6/1988 | Cook et al. | 123/520 |
| 4,915,713 | 4/1990 | Buzza et al. | 55/270 |
| 4,949,695 | 8/1990 | Uranishi et al. | 123/494 |

FOREIGN PATENT DOCUMENTS

| | | | |
|---|---|---|---|
| 0020753 | 2/1981 | Japan | 123/518 |
| 1-3258 | 1/1989 | Japan . | |
| 1-190955 | 8/1989 | Japan . | |

*Primary Examiner*—E. Rollins Cross
*Assistant Examiner*—Thomas N. Moulis
*Attorney, Agent, or Firm*—Sughrue, Mion, Zinn, Macpeak & Seas

[57] ABSTRACT

An evaporated fuel gas purging system comprises a chamber having a case and a cap, the chamber being divided into a plurality of sub-chambers by partitioning plates each having through holes; a pair of electrodes provided in one of the sub-chambers, the one of sub-chambers being filled with an adsorbent and communicating with the other sub-chambers having an inlet port, an outlet port and a purge port, respectively; and a control circuit for detecting changes in electrical characteristics between the electrodes so that the amount of a fuel gas adsorbed by the adsorbent is detected. An evaporated fuel gas purging system further comprises a purging unit for purging the adsorbed gas, a control unit for controlling the purging unit, and a display unit operating in response to quantitative changes in the amount of the adsorbed gas. The display unit is operated in case a preserved difference does not occur in the amount of the adsorbed gas found by comparing the amount of the adsorbed gas detected at the time when the purging unit is not in operation and the amount of the adsorbed gas detected after the elapse of a prescribed duration of time after the control unit operated to put the purging unit into its operation.

4 Claims, 3 Drawing Sheets

EVAPORATED FUEL GAS PURGING SYSTEM

BACKGROUND OF THE INVENTION

The present invention relates to an evaporated fuel gas purging system for adsorbing and purging a gas resulting from the evaporation of a fuel in a fuel tank on an automobile or the like.

Conventionally, an automobile has been provided with an evaporated fuel gas purging system, which controls the adsorption and purging of a evaporated fuel gas in a fuel tank in accordance with the operation of an engine, so that the evaporated fuel gas is not discharged into the atmosphere.

A conventional evaporated fuel gas purging system is not provided with any means of measuring the amount of the gas which is adsorbed by the system. However, in order to adapt the intensified control over the exhaust gas from automobiles, there has emerged the necessity for controlling the evaporated fuel gas with the knowledge on the amount of adsorption thereof.

Further, according to the conventional evaporated fuel gas purging system, a failure in the control of the adsorption and purging of the gas will result in the discharge of all the amount of the gas into the atmosphere after a prescribed amount of the gas has been adsorbed, so that the environment will be damaged considerably if the system continues to be used in its state of failure.

SUMMARY OF THE INVENTION

The present invention has been made with a view to overcome the problems as described above. An object of the present invention is to provide an evaporated fuel gas purging system equipped with a measuring mechanism so that it is capable of measuring the amount of the adsorbed gas economically and efficiently.

Another object of the present invention is to provide an evaporated fuel gas purging system which is capable of giving an alarm signal to an operator immediately when a trouble occurs in the adsorbing and purging control process.

The evaporated fuel gas purging system according to the present invention is constructed such that a chamber composed of a case and a cap is divided into a plurality of sub-chambers by means of partitioning plates, each of which has through holes and one of the sub-chambers thus partitioned off contains therein a pair of electrodes opposite to each other and also contains an adsorbent filled up in the entire space thereof including the space between the electrodes, and the other sub-chambers communicating with the sub-chamber defined above are provided with an inlet port, an outlet port and a purge port, respectively, and a control circuit which detects the changes in the electrical characteristics between the electrodes defined above is provided either on the outer circumference of the case defined above or that of the cap or in any one of the sub-chambers partitioned off as defined above.

The evaporated fuel gas purging system according to the present invention is designed to be capable of detecting the changes in the electrical characteristics due to the adsorption and separation of the gas, using the adsorbent itself as an electrical medium, by the electrodes set in the sub-chamber filled up with the adsorbent.

Further, the evaporated fuel gas purging system according to the present invention is provided with a purging means which purges the adsorbed gas, a control means which controls the purging means, and a display means which operates in response to the quantitative changes in the amount of the adsorbed gas. The display means is operated in case a prescribed difference does not occur in the amount of the gas found by comparing the amount of the adsorbed gas at the time when the purging means is not in operation and the amount of the adsorbed gas measured after the elapse of a prescribed duration of time after the control means operated to put the purging means into its operation.

DETAILED DESCRIPTION OF THE PREFERRED EMBODIMENTS

The preferred embodiments of the present invention will now be described with reference to the accompanying drawings.

Figure 1:
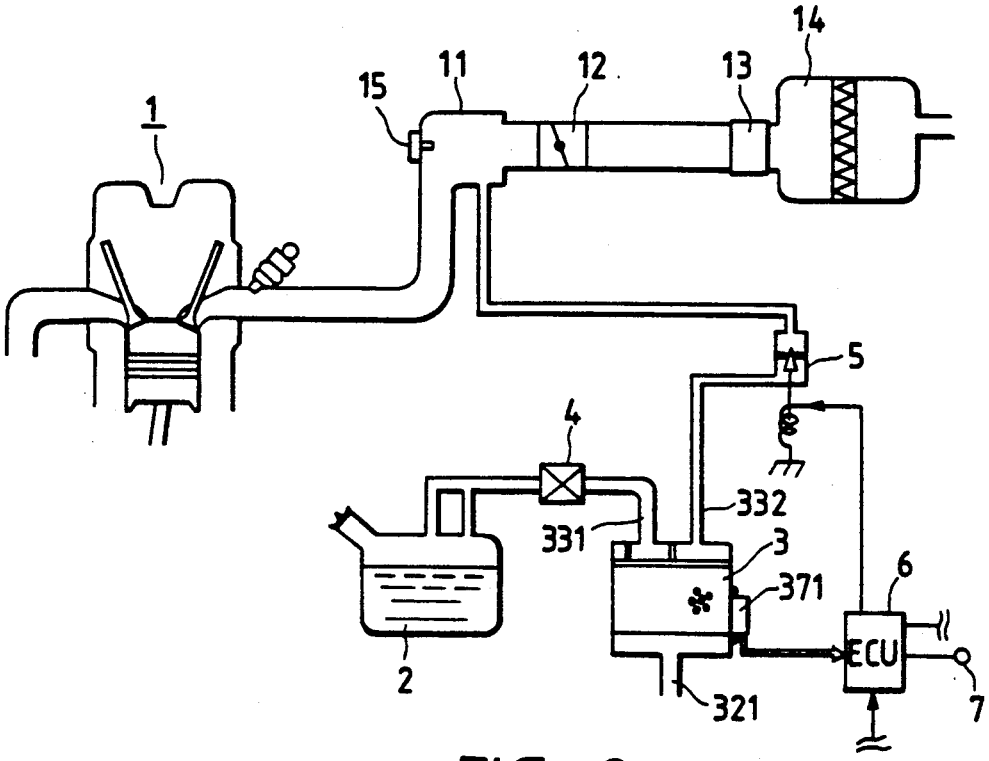
FIG. 1 is a view illustrating the construction of an evaporated fuel gas purging system according to one embodiment of the present invention.

FIG. 1 is a view illustrating the construction of an evaporated fuel gas purging system according to the present invention, wherein reference number 1 indicates an engine of an automobile or the like, reference number 11 indicates an intake manifold fitted to this engine 1, reference number 12 indicates a throttle valve which regulates the amount of air intake, reference number 13 indicates an air flow gauge, reference number 14 indicates an air cleaner through which the atmospheric air is introduced, and reference number 15 indicates a pressure sensor which detects the pressure inside the intake manifold 11. Further, reference number 2 indicates a fuel tank, reference number 3 indicates an evaporated fuel gas adsorbing apparatus, reference number 4 indicates a check valve provided in a line between the fuel tank 2 and the evaporated fuel gas adsorbing apparatus 3, reference number 5 indicates a purge control valve which controls the purging amount, reference number 6 indicates an engine control unit, and reference number 7 indicates a display lamp. Moreover, reference number 321 indicates an outlet port in the evaporated fuel gas adsorbing apparatus 3, reference number 331 indicates an inlet port, reference number 332 indicates a purge port, and reference number 371 indicates a control circuit, respectively, of the evaporated fuel gas adsorbing apparatus 3.

Figure 2:
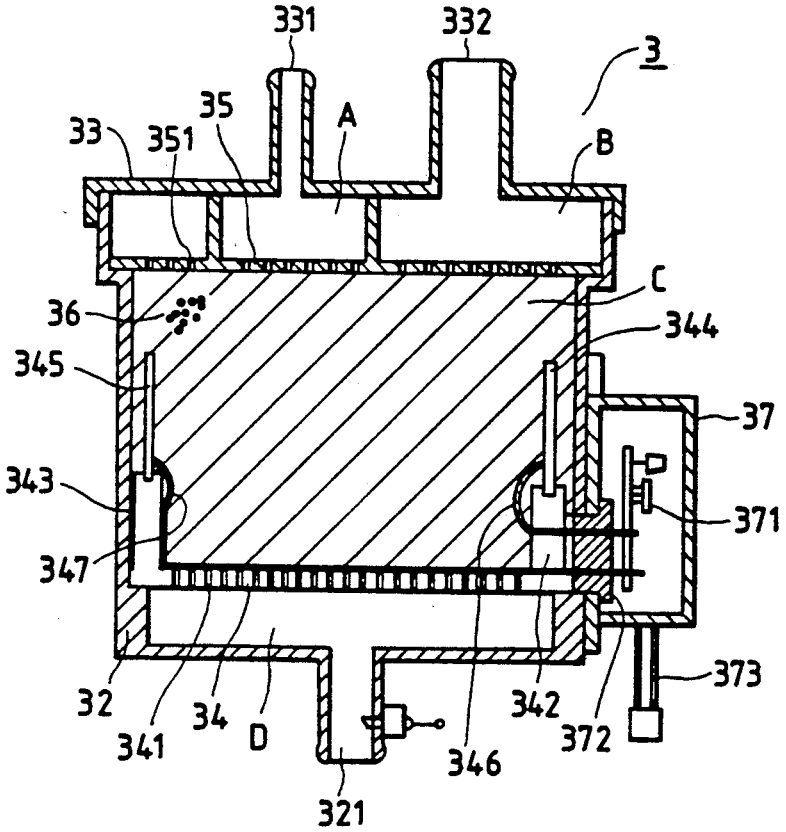
FIG. 2 is a sectional view illustrating a section of an evaporated fuel gas adsorbing apparatus of the purging system.

FIG. 2 is a view illustrating the details of the construction of the evaporated fuel gas adsorbing apparatus 3 mentioned above. As shown in this drawing, a partitioning plate 34, which has a plural number of through holes 341 in its lower part, and a partitioning plate 35, which likewise has a plural number of through holes 351 in its upper part are set up in a chamber hermetically sealed with a case 32, which has an outlet port 321 in its bottom for the discharge of the air into the atmosphere and with a cap 33 having an inlet port 331 and a purge port 332 for the evaporated fuel gas, and these partitioning plates 34 and 35 divide the above-mentioned chamber into the sub-chambers A, B, C, and D in the upward-downward direction. The sub-chamber A communicates with the inlet port 331, the sub-chamber B communicates with the purge port 332, the sub-chamber D communicates with the outlet port 321, and the sub-chamber C communicates with the sub-chambers A, B, and D, respectively, by the through holes 341 and 351.

Moreover, the sub-chamber C has electrodes 344 and 345 set up on holding parts 342 and 343 formed on the partitioning plate 34, in such a manner that one of the electrodes faces the other, and, in addition, an adsorbent 36 made of activated charcoal is filled up to the full in the sub-chamber C. The electrodes 344 and 345 are connected via lead wires 346 and 347 with a control circuit 371 provided on the outside surface of the case 32. Reference number 37 indicates a package which houses the control circuit 371, reference number 372 indicates grommets for leading out the lead wires 346 and 347, and reference number 373 indicates an external lead wire terminal.

Figure 3:
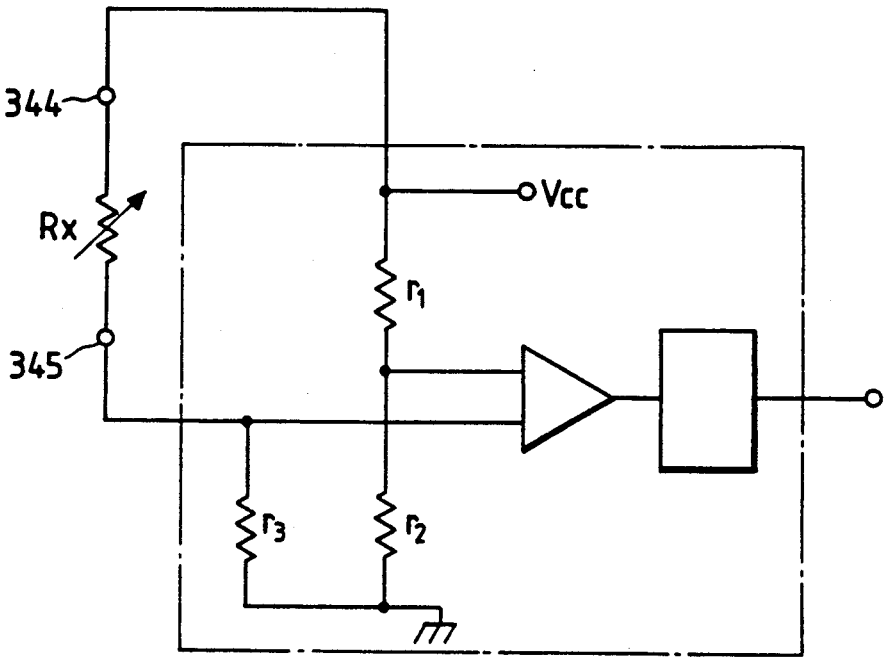
FIG. 3 is a circuit diagram showing a control circuit for detecting the amount of adsorption.
Figure 4:
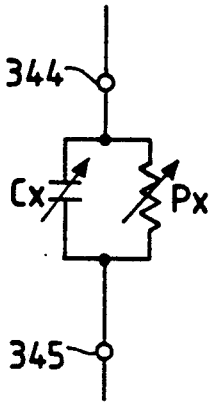
FIG. 4 is a circuit diagram showing an electrical equivalent circuit in another circuit for detecting the amount of adsorption.

FIG. 3 is a circuit diagram showing an example of the control circuit 371 mentioned above, which detects the changes in the electrical resistance $R_x$ between the electrodes 344 and 345, reference marks $r_1$ through $r_3$ represent bridge circuit resistors, and reference mark $V_{cc}$ represents a voltage of a power source. Moreover, FIG. 4 shows an equivalent circuit between the electrodes 344 and 345 in view of an electrical capacitance $C_x$ between the electrodes 344 and 345.

Next, the operations of the evaporated fuel gas purging system according to the present invention will be described. The gas generated by the evaporation of the fuel in the fuel tank 2 flows through the check valve 4 and the inlet port 331 into the sub-chamber A as the pressure in the fuel tank is increased by the increase of the amount of the evaporated fuel gas. The evaporated fuel gas further passes through the through holes 351 and flows into the sub-chamber C, in which the evaporated fuel gas is adsorbed by the adsorbent 36, and only the air in the gas is led into the sub-chamber D through the through holes 341 and then discharged into the atmosphere through the outlet port 321. Also, in case the purging conditions are fulfilled for the engine 1, together with the air which has flown through the outlet port 321, the fuel gas which has been adsorbed by the adsorbent 36 is separated and passes through the sub-chamber B and is discharged through the purge port 332 towards the side of the intake manifold 11 and sucked into the engine together with the air flowing from the air cleaner 14 via the air flow gauge 13 and the throttle valve 12.

The adsorption of the evaporated fuel gas by the adsorbent 36 and the separation of the adsorbed gas from the adsorbent 36 cause changes in the electrical characteristics, such as electrical conductivity and dielectric constant, of the adsorbent 36. Accordingly, also the resistance value $R_x$ and the capacitance value $C_x$ between the electrodes 344 and 345 installed in the sub-chamber C will undergo changes as the result of the adsorption of the gas and the separation of the adsorbed gas. Hence, as shown in FIG. 3, when the voltage $V_{cc}$ of the power source is applied between opposing two poles of a bridge circuit formed of the resistance $R_x$ between the electrodes 344 and 345 as one side of the bridge, and the fixed resistors $r_1$ through $r_3$ as the three other sides, a voltage is generated between the other opposing two poles in the bridge circuit in accordance with the changes of the resistance $R_x$. Thus, the changes in the voltage make it possible to measure the adsorbed amount of the evaporated fuel gas. Also, the adsorbed amount of the evaporated fuel gas may be measured through the detection of the change of the capacitance value $C_x$ by a well-known bridge method.

Further, according to the present invention, factors to cause inaccuracy in the detected amount of adsorbed gas, can be removed. That is, the electrical characteristics will change not only in accordance with the amount of the gas but also under the influence of temperature and the humidity in the air. Thus, in case the degree of change in such factors as temperature is considerable, the determination of the amount of adsorption will become ambiguous, lacking in accuracy. To overcome this disadvantage, a method of making corrections by the use of a temperature sensor or the like is available, but such an approach will be economically disadvantageous. On the other hand, the purging time is usually a short duration of time, in which the temperature of the evaporated fuel gas adsorbing apparatus will not change considerably. Therefore, the factors such as temperature and humidity can be excluded by making a comparison of the signal output on the amount of adsorption immediately before the release of the purge control valve 5 and the signal output after the release of the purge control valve 5 at a time when the purge is normally fully completed.

Figure 5:
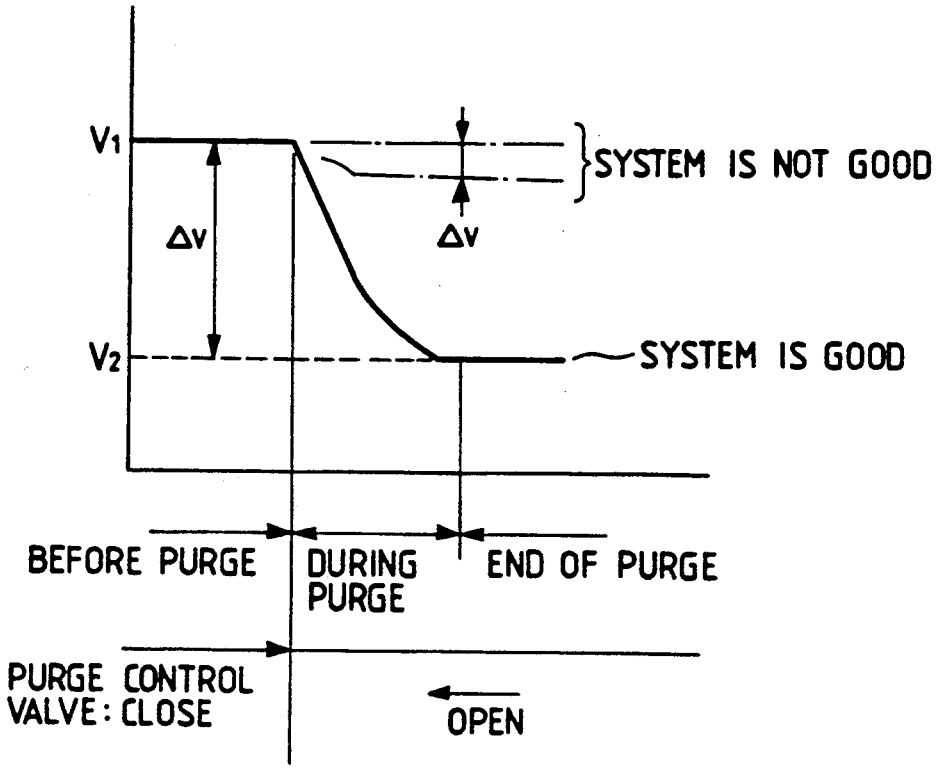
FIG. 5 is a view illustrating the operations of the purging system.

That is to say, as shown in FIG. 5, which illustrates the operations of the system, when the difference $\Delta v$ between the adsorption signal $V_1$ at the time when the purge control valve is closed and the adsorption signal $V_1$ at the time when the purging operation is ended after the elapse of a prescribed duration of time (for example, 30–60 seconds) with the purge control valve kept open, is a value in excess of a prescribed value (for example, 5–15% of signal $V_1$), it is regarded that the purging operation is in its normal state. The value $\Delta v$ will be either zero or in an extremely small value if the purging operation is in failure. In this regard, when the temperature changes to shift the adsorption signal $V_1$ prior to the purging operation by the value $\Delta v_t$, the adsorption signal $V_2$ after the purging operation, will likewise shift by $\Delta V_t$, so that the difference between the two signals will still remain $\Delta v$. This $\Delta v$ is put into the engine control unit 6, and the display lamp 7 is turned on to alert the operator in case the value $\Delta v$ does not attain the prescribed value.

Figure 6:
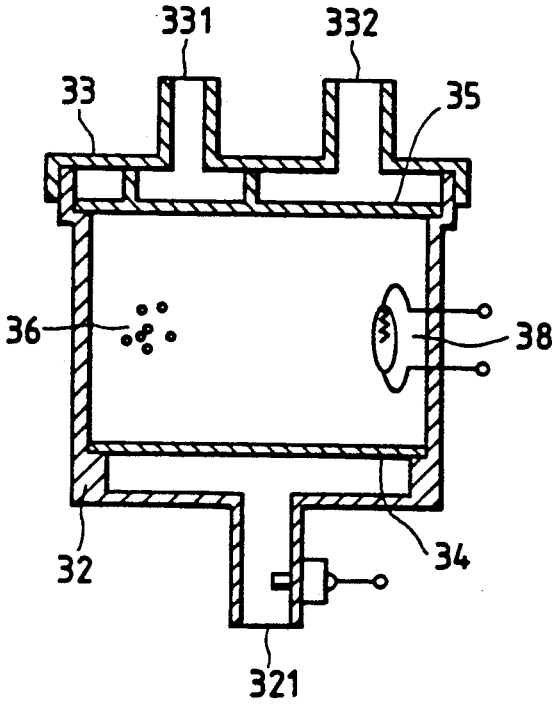
FIG. 6 is a construction view illustrating another method of detecting the amount of adsorption.

The description made so far relates to a measuring method which uses the changes in the electrical characteristics due to the amount of adsorption by the adsorbent 36 provided in the evaporated fuel gas adsorbing apparatus 3, but, a similar effect can be achieved also through utilization of changes in the temperature of the gas detected by a temperature sensor 38 embedded in the adsorbent 36, as illustrated in FIG. 6.

As described hereinabove, the present invention offers an evaporated fuel gas purging system which is capable of detecting the amount of the adsorbed fuel gas in an economical and efficient manner with a simple mechanism because the system is provided with electrodes in a sub-chamber filled up with an adsorbent and, using the adsorbent itself as an electrical medium, detects the changes which occur in the electrical characteristics as the result of the adsorption of the gas and the separation of the adsorbed gas.

Further, the present invention offers an evaporated fuel gas purging system which is designed to determine whether or not the performance of the purging system is in a satisfactory state of operation on the basis of a comparison between the amount of adsorption prior to the start of the purging operation and the amount of adsorption after the elapse of a prescribed duration of time after the start of the purging operation, which are detected by a gas adsorption detecting means provided in the evaporated fuel gas adsorbing apparatus. Accordingly, the gas purging system is capable of accurately determining whether or not the purging system is in a satisfactory state of its operation, without any addition of a temperature sensor or the like, and therefore giving an alarm signal to the operator immediately when a failure occurs in the control operation in the system.

What is claimed is:

1. An evaporated fuel gas purging system, comprising:

a chamber having a case and a cap, said chamber being divided into a plurality of sub-chambers by means of partitioning plates each having through holes;

a pair of electrodes provided in one of said sub-chambers, said one of sub-chambers being filled with an adsorbent and communicating with the other sub-chambers having an inlet port, an outlet port and a purge port, respectively; and a control circuit for detecting changes in electrical characteristics of said adsorbent between said electrodes so that an amount of a fuel gas adsorbed by said adsorbent is detected.

2. An evaporated fuel gas purging system as claimed in claim 1, wherein said pair of electrodes are provided so as to be opposite to each other so that changes in electrical resistance or capacitance of said adsorbent between said electrodes are detected by said control circuit.

3. An evaporated fuel gas purging system as claimed in claim 2, wherein said control circuit is a bridge circuit using the electrical resistance of said adsorbent between said electrodes as one side of said bridge circuit.

4. An evaporated fuel gas purging system as claimed in claim 1, further comprising a purging means for purging said adsorbed fuel gas adsorbed by said adsorbent, a control means for controlling said purging means, and a display means operating in response to quantitative changes in the amount of said adsorbed gas, wherein said display means is operated in case a preserved difference does not occur in the amount of said adsorbed gas found by comparing the amount of said adsorbed gas detected at the time when said purging means is not in operation and the amount of said adsorbed gas detected after the elapse of a prescribed duration of time after said control means operated to put said purging means into its operation.

* * * * *